US007977589B2

(12) United States Patent
Lunn et al.

(10) Patent No.: US 7,977,589 B2
(45) Date of Patent: Jul. 12, 2011

(54) MEASURING CONTACT SEQUENCE IN A TAP CHANGER

(75) Inventors: Lena Lunn, Ludvika (SE); Johan Kemppi, Ludvika (SE)

(73) Assignee: ABB Technology Ltd. (CH)

( * ) Notice: Subject to any disclaimer, the term of this patent is extended or adjusted under 35 U.S.C. 154(b) by 0 days.

(21) Appl. No.: 12/756,604

(22) Filed: Apr. 8, 2010

(65) Prior Publication Data

US 2010/0263996 A1 Oct. 21, 2010

(30) Foreign Application Priority Data

Apr. 20, 2009 (EP) ..... 09158210

(51) Int. Cl.
*H01H 21/00* (2006.01)

(52) U.S. Cl. ..... 200/11 TC

(58) Field of Classification Search ..... 200/11 TC, 200/18, 275, 8 A, 11 B, 5 R; 323/254, 255, 323/340, 341
See application file for complete search history.

(56) References Cited

U.S. PATENT DOCUMENTS 3,176,089 A * 3/1965 Bleibtreu et al. ..... 200/18
3,735,243 A 5/1973 Downs et al.
4,207,445 A * 6/1980 Hammar ..... 200/11 TC
4,496,805 A * 1/1985 Duenke ..... 200/11 TC
6,849,813 B1 * 2/2005 Albrecht ..... 200/11 TC

FOREIGN PATENT DOCUMENTS

DE 102004052316 B3 12/2005

OTHER PUBLICATIONS

Extended European Search Report; EP 09 15 8210; Sep. 2, 2009; 5 pages.

* cited by examiner

*Primary Examiner* — Edwin A. Leon
(74) *Attorney, Agent, or Firm* — St. Onge Steward Johnston & Reens LLC

(57) ABSTRACT

A tap changer and a method for measuring a contact sequence of a tap changer is provided. The tap changer includes a cylinder and a shaft that is rotatably arranged inside the cylinder, the cylinder is provided with fixed contacts, the shaft is provided with a contact circuit facing the cylinder and including mechanical contacts, which mechanical contacts are adapted to selectively mate with the fixed contacts of the cylinder upon rotation of the shaft, the contact circuit also includes at least two measuring points for measuring the function of the contact circuit. The tap changer includes at least one measuring contact device, which is electrically connected to the respective measuring points in the contact circuit, and which the measuring contact device is arranged inside the shaft. This facilitates access to the measuring points of the tap changer.

14 Claims, 7 Drawing Sheets

MEASURING CONTACT SEQUENCE IN A TAP CHANGER

CROSS-REFERENCE TO RELATED APPLICATIONS

The present application claims priority of European patent application No. 09158210.6 filed on Apr. 20, 2009, the content of which is incorporated herein by reference.

FIELD OF THE INVENTION

The present invention relates to a tap changer of a transformer, and monitoring the performance of the tap changer.

BACKGROUND OF THE INVENTION

The invention relates to a tap changer for a transformer, especially cylindrical tap changers wherein an insulated cylinder is provided with fixed tap contacts for different voltage levels and a rotatable shaft provided with corresponding movable contact parts is arranged inside the cylinder. Each movable contact faces outwardly from the shaft towards the inside of the cylinder and comprises at least one or, for example, two mechanical contacts that can be brought into contact with the corresponding fixed contact of the cylinder.

In an example of a known type of tap changer that comprises a plurality of mechanical contacts that rotate together with the shaft, the mechanical contacts are arranged in parallel contact branches for connection to the fixed contacts of the tap levels. One of the mechanical contacts is connected in series with a vacuum interrupter switch, and the other of the mechanical contacts is connected in series with a second vacuum interrupter and a resistor. In a multi-phase system, the transformer comprises tap levels for each phase, and each phase includes two movable mechanical contacts arranged on the rotating shaft of the tap changer.

A tap changer of this cylindrical type is described in DE 10 2004 052 316. The document describes how the contact sequences of the tap changer are measured. The measurements are performed by connecting a measuring circuit between the two parallel branches. The measuring circuit is connected by removing the shaft from the cylinder, the measuring circuit is then connected to the two branches of the movable contacts via connecting cables, where-after the shaft is re-installed in the cylinder (§25). The measuring circuit is connected at a first connection point between the mechanical switch and the vacuum interrupter in the first branch, and a second connection point between the resistor and the vacuum interrupter of the second branch. The measuring circuit comprises a DC voltage source and a resistor in series and the voltage across the resistor is monitored (FIGS. 6 to 8). During a tap change, one of the branches is disconnected from the present tap level and is connected to the next level before the other branch. The measuring circuit registers voltage variations during the tap change, for example, from the opening of the vacuum interrupter of the resistor branch at the present tap level, to the closure of the vacuum interrupter of the other branch at the next level (§28). The measuring provides valuable information on the status of the switches, but is complicated and laborious.

Also, the reinstallation of the tap changer is complicated and may affect the tap changer and its contacts, so that the results of the measuring become invalid.

Moreover, this measuring circuit can not detect the opening of the mechanical switch in the resistor branch, when both branches are connected in parallel to the same tap.

SUMMARY OF THE INVENTION

It is an object of the invention to overcome the disadvantages of the prior art and to provide a tap changer, a transformer and a method for measuring contact sequences of a tap changer in a transformer.

It is an object to provide a tap changer and a measuring method that are useable both in the factory during manufacture and for monitoring tap changers in the field.

The invention provides a tap changer in accordance with claim 1, wherein contacts are arranged inside the shaft of the tap changer, which facilitates access to the measuring points of the tap changer.

These contacts can be suitably arranged for easy access and to provide a connection between contact circuits of the tap changer to measuring equipment while the tap changer is located in a transformer, so that the tap changer does not need to be removed from the transformer when the functionality of the tap changer is tested.

The invention also provides a measuring method in accordance with claim 11, wherein the performance of the contacts can be measured with the tap changer positioned inside the transformer during the measuring session.

Method for measuring a contact sequence of a tap changer in a transformer, which tap changer is arranged inside the transformer and comprises a cylinder and a shaft that is rotatably arranged inside the cylinder, the cylinder is provided with fixed contacts facing inwards from its interior surface, the shaft is provided with a contact circuit including mechanical contacts facing towards the cylinder and are adapted to selectively mate with the fixed contacts of the cylinder upon rotation of the shaft, wherein measuring contact devices are arranged inside the shaft, which contact devices are electrically connected to measuring points of the contact circuit, the method comprises opening and closing the contacts of the contact circuit and measuring electrical variations during the opening and closing of the contacts. The method is characterised by inserting a measuring probe provided with measuring contacts into the shaft of the tap changer.

Preferably the step of inserting the measuring probe is performed with the tap changer present inside the transformer.

By performing a measuring of a contact sequence of the tap changer, on a tap changer that is arranged inside a transformer, valuable time and labour can be saved. Since the tap changer is not removed from the transformer, the risk of affecting the tap changer lessens considerably, since it the shaft of the tap changer with its contacts does not need to be re-installed inside cylinder.

The embodiments of the tap changer and the method of the invention facilitate measuring of contact sequences in a variety of tap changers. The inventive method and tap changer can be used to improve many types of cylindrical tap changers, and facilitate the monitoring and maintenance of their contacts.

In an embodiment the measuring contact device of the tap changer comprises at least two individual contact surfaces, and the contact circuit comprises two measuring points, wherein each of the contact surfaces is connected to a respective one of the measuring points. In this way connection to the contact device by measuring equipment provides access to both measuring points.

In an embodiment the tap changer comprises three measuring contact devices and three contact circuits, wherein each of the contact devices is arranged inside the shaft and is connected to a respective one of the three contact circuits. This is especially useful for three-phase systems. In an embodiment the measuring contact device comprises three individual contact surfaces, and the contact circuit comprises three measuring points, wherein each of the contact surfaces is connected to a respective one of the measuring points. Having three measuring points for every phase provides enhanced measuring capabilities.

A preferred embodiment includes a plurality of conductors arranged between a respective measuring point and contact surface and extends from an outside of the shaft to a respective one of the contact surfaces inside the shaft.

In an embodiment the tap changer comprises a top portion with a cover (19) and a sealable opening (9) arranged in the cover (19), which sealable opening (9) is arranged to provide access into the shaft (2). Thus, the shaft with contacts can be accessed for testing and the tap changer can be sealed when the transformer is used for power transmission.

In an embodiment the contact circuit comprises two branches, the first branch comprising a first mechanical contact, a first vacuum interrupter and a protective resistor, the second branch comprises a second mechanical contact and a second vacuum interrupter. Tap changers with vacuum interrupters are beneficial for medium and high voltage transformers, such as above 5 kV. Tap changers with vacuum interrupters requires less maintenance than tap changers having only mechanical contacts. The invention is beneficial also for tap changers with only mechanical contacts.

Preferably the measuring method includes the step of connecting the measuring contacts with the contact devices, which connecting step is performed after the insertion of the measuring probe into the shaft.

Preferably the measuring method includes the step of removing the measuring probe from the shaft including removing the measuring probe out of the transformer, which step is performed after the step of opening, closing and measuring. Moving the measuring probe out of the transformer is less complicated and less laborious than lifting the whole centre shaft including the movable contacts out of the transformer.

Preferably the measuring method includes the step of closing the tap changer after the step of removing the measuring probe. In this way the transformer is sealed and can be reconnected to a power transmission grid.

The invention also provides a transformer including and taken advantage of the inventive tap changer. The transformer comprises two windings, one of which is a regulating winding, and the tap changer arranged to select a tap level of the regulating winding.

The invention also provides measuring equipment for measuring a contact sequence in the inventive tap changer. The measuring equipment comprises a measuring probe provided with measuring contacts adapted for a mating connection to the at least one contact device that are arranged inside the shaft of the tap changer.

The invention provides a tap changer and a method by means of which the functioning of all the individual switches can be monitored. The method can be used during manufacturing and installation as well as for controlling the function and maintenance of the tap changer during its entire lifespan.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

DETAILED DESCRIPTION OF THE INVENTION

Figure 1:
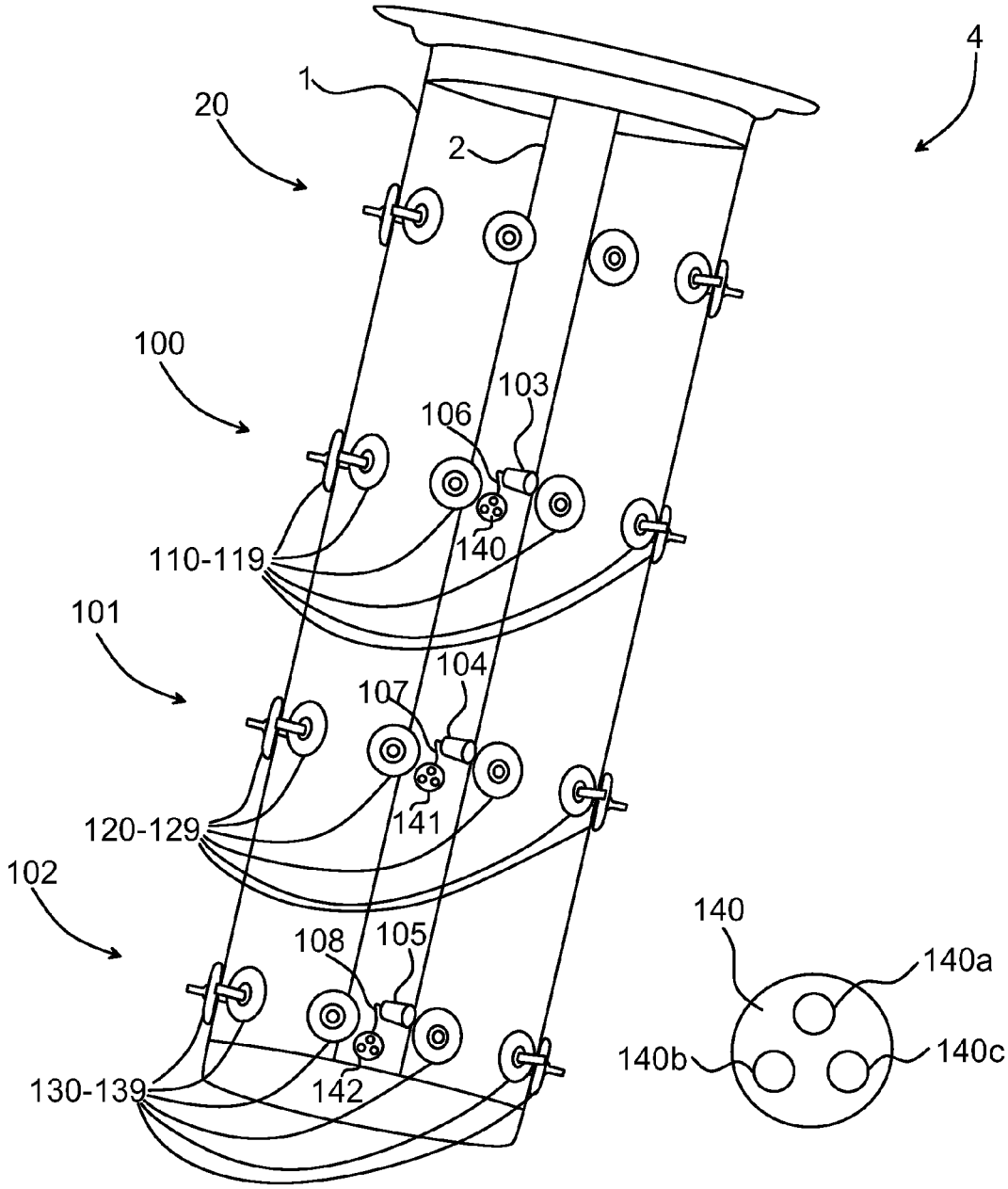
FIG. 1 illustrates a tap changer.
Figure 3:
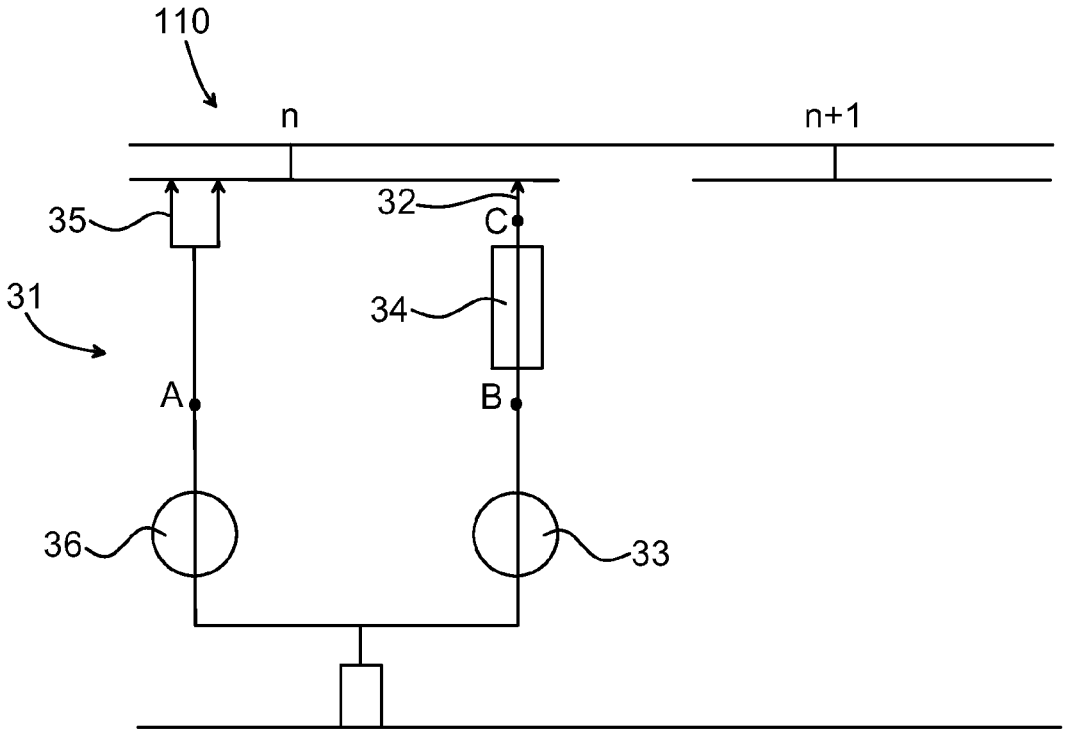
FIG. 3 illustrates a circuit diagram of the tap changer.
Figure 4:
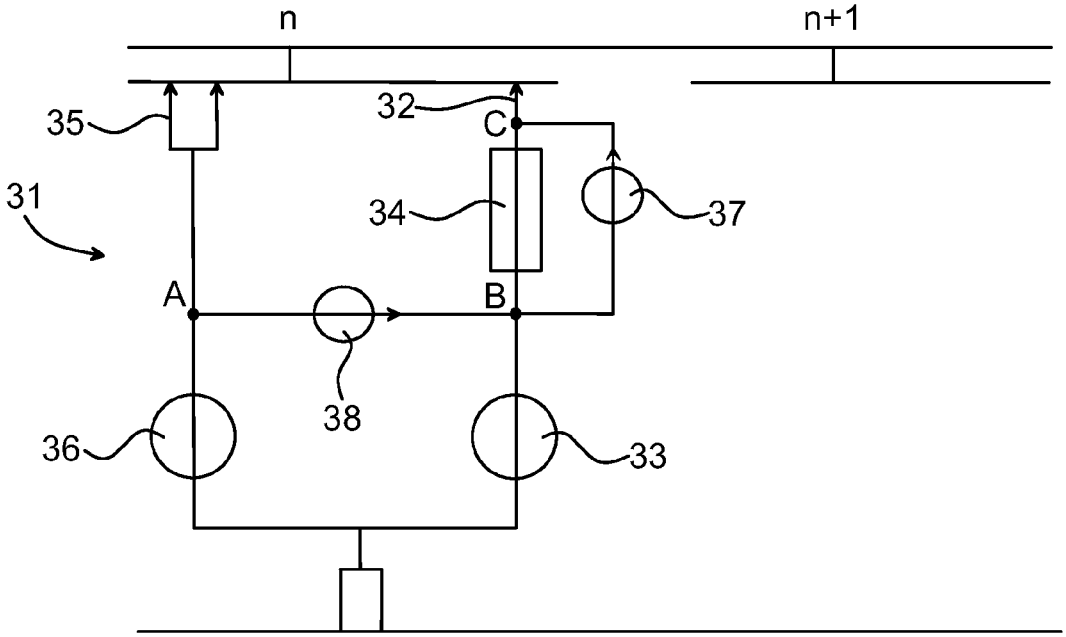
FIG. 4 illustrates a circuit diagram of the tap changer connected to measuring equipment.

FIG. 1 illustrates a cylindrical tap changer 4 for installation in a transformer and connection to a regulating winding of the transformer. The tap changer 4 comprises an outer cylinder 1 surrounding an interior shaft 2. The shaft 2 is rotatably arranged inside the cylinder 1. The tap changer 4 is adapted for three phases and has terminal arrangements 100-102 for each of the three phases 100-102 arranged at three heights following the circumference at three levels 100-102 of the cylinder 2. Each level includes a plurality of spaced apart terminals 110-139, on the outside of the cylinder 2, for providing connections to a plurality of different taps of each of the regulating windings (not illustrated) of the transformer. The figure illustrates a tap changer 4 having ten terminals 110-139 for each phase, of which six terminals 110-139 is visible in the figure, the remaining four are arranged on the hidden side of the cylinder. Each of the terminals 110-139 around the cylinder provides an electrical connection to corresponding fixed contacts (3 in FIG. 2) inside the cylinder 2. These fixed contacts face inwardly towards the shaft 2 at the centre of the cylinder 1. The shaft 2, in turn, is provided with contact arrangements 103-105 facing outwards towards the fixed contacts of the cylinder 1. The shaft 2 includes three such contact arrangements 103-105, one for each phase. The contact arrangements 103-105 comprise mechanical contacts attached to the shaft 2, and movable upon rotation of the shaft 2 into contact with the fixed contacts of the cylinder 1, so that a specific tap 110-139 for each phase can be chosen by rotating the shaft 2 so that each contact arrangement 103-105 of the shaft is brought into mating contact with a corresponding fixed contact in the cylinder 1 for each phase. The contact arrangements 103-105 suitably also includes vacuum interrupters (33, 36 in FIG. 3) in series with the mechanical contacts. In the diagram of FIGS. 3 and 4 the mechanical contacts (at 32, 35), and the vacuum interrupters (at 33, 36), arranged between the shaft and the cylinder, are illustrated. These contact arrangements 103-105 are connected by means of respective cables 106-108, to contact devices 140-142, which are arranged inside the shaft 2, i.e. the shaft is hollow and provided with contact devices 140-142 in its interior, one such contact device for each phase.

Each contact device 140-142 is illustrated as comprising three contacts and it is preferred that each cable 106-108 includes three conductors electrically connected to three different measuring points in the contact arrangements 103-105. These measuring points (A, B, C) are illustrated further in FIGS. 3 and 4. Each of the three contact devices 140-142 includes three measuring contacts 140A-C, and these measuring contacts 140A-C are adapted and arranged for providing an electrical connection to the measuring equipment illustrated in FIG. 5. For this purpose the measuring equipment includes a rod 51 provided with three groups 52*a-c* of measuring contacts arranged spaced apart the same distance as the contact devices 140-142 are spaced apart. An enlarged view of the three measuring contact surfaces 140A-C of the contact devices 140-142 is provided in FIG. 1 on the right side of the tap changer 4.

The illustrated tap changer 4 also comprises a pre-selector 20, but the invention can be used in tap changers that does not comprise a pre-selector.

Figure 2:
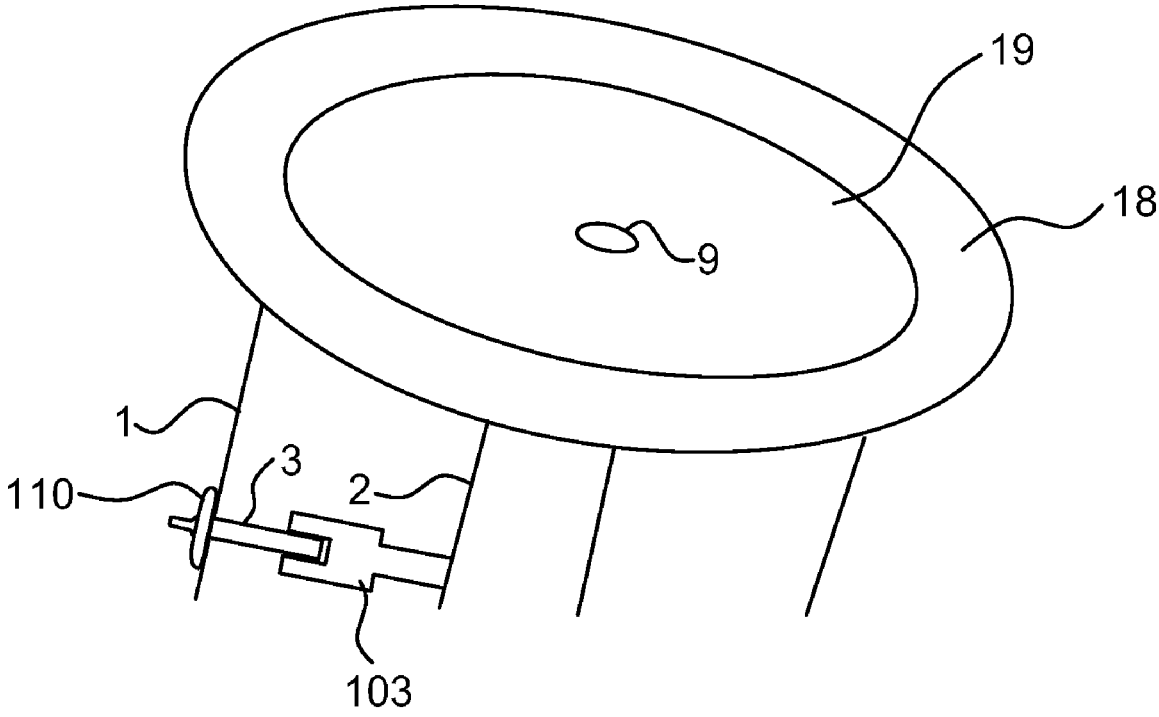
FIG. 2 illustrates a top section of the tap changer of FIG. 1.

FIG. 2 illustrates a top end of the tap changer 4 of FIG. 1, showing the cylinder 1 with the shaft 2 rotatably arranged inside, and a cover 19 on the top of the cylinder. A mechanical contact 32 of the contact arrangements 103-105 is illustrated in mating contact to a fixed contact 3 arranged on the interior side of the cylinder 1 and providing a connection to a tap terminal 110 on the outside of the cylinder 1. The cover is provided with a sealable opening 9 for entering measuring devices (such as the rod 51 in FIG. 5) comprising measuring contacts (52 in FIG. 5) for connection to the internal measuring contacts (140*a-c* in FIG. 1) of the shaft. The cover can be provided as a removable lid that closes the access opening into the shaft during use of the transformer. When the performance of the tap changer 4, and its contacts 103-105, is measured, the lid is removed so that access to the measuring contacts 140-142 inside the shaft is provided for the measuring equipment. This access can be provided with the tap changer 4 still inside the transformer, so that the tap changer 4 does not need to be lifted and removed from that transformer when a measuring session is performed.

FIG. 3 illustrates a contact circuit 31 suitable for the contact arrangements 103-105, for each phase, of the shaft, which contact arrangements 103-105 are connected to the fixed contact 3 of the cylinder at a tap n of the regulating winding. Thus the contact circuit 31 is an example of a movable contact 103-105 of the shaft 2. The contact circuit 31 comprises two mechanical contacts 32, 35 adapted to mate into contact with the corresponding fixed contacts (3) of the cylinder. The mechanical contacts 32, are arranged in two parallel branches for connection to the fixed contacts of the tap levels, illustrated as n and n+1. One of the mechanical contacts 35 is connected in series with a vacuum interrupter switch 36, and the other of the mechanical contacts 32 is connected in series with a second vacuum interrupter 33 and a resistor 34. When the movable contact 31 is moved from a first tap n, and a first fixed contact of the cylinder, to a second tap n+1, the branch including the resistor 34 and vacuum interrupter 33 is moved into contact with the second fixed contact of tap n+1. The resistor 34 acts to protect the tap changer 4 from circulating currents resulting from the connection to the two taps (n, n+1). The shaft is suitably also arranged so that it can be rotated backwards from tap n+1 to the first tap n, in which case the branch that includes the resistor 34 moves last from the second tap n+1, and the resistor 34 will also in this case protect the contact circuit 31 from the circulating currents.

The movable contact 31 is provided with measuring points A, B, C in the two branches of the circuit for measuring the performance of the contacts 32, 33, 35, 36. A first measuring point A is provided between the first mechanical contact 35 and the first vacuum interrupter 36, i.e. in the connection from the first mechanical contact 35 to the first vacuum interrupter switch 36 of the first branch. A second and a third measuring point B, C is provided between the second mechanical contact 32 and the second vacuum interrupter 33, i.e. in the connection from the second mechanical contact 32 to the second vacuum interrupter switch 33 of the second branch. These measuring points are provided on a respective side of the protective resistor 34. The second measuring point B is provided between the second vacuum interrupter 33 and the resistor 34. The third measuring point C is provided between the second mechanical contact 32 and the resistor 34.

FIG. 4 illustrates measuring devices 37, 38 connected to the measuring points A, B, C of the movable contact 31 of the shaft. A first measuring device 37 is connected between the second B and third C measuring points and in parallel with the resistor 34. The second measuring device is connected between the two branches, i.e. between the first measuring point A in the first branch, and the second measuring point B of the second branch. Each of the measuring devices comprises a DC current source and a voltage meter registering voltage as a function of the time. Alternatively, the currents and voltages between A and B, and between B and C are measured by voltage meters and ampere meters and the resistance for contacts of the circuit, and the resistance variation upon opening and closing the contacts are determined. The measurements can be used to determine the status of each contact, e.g. level 1 for a closed contact and level 0 for an open contact, and be presented as a function of time as is illustrated in FIG. 6.

Figure 5:
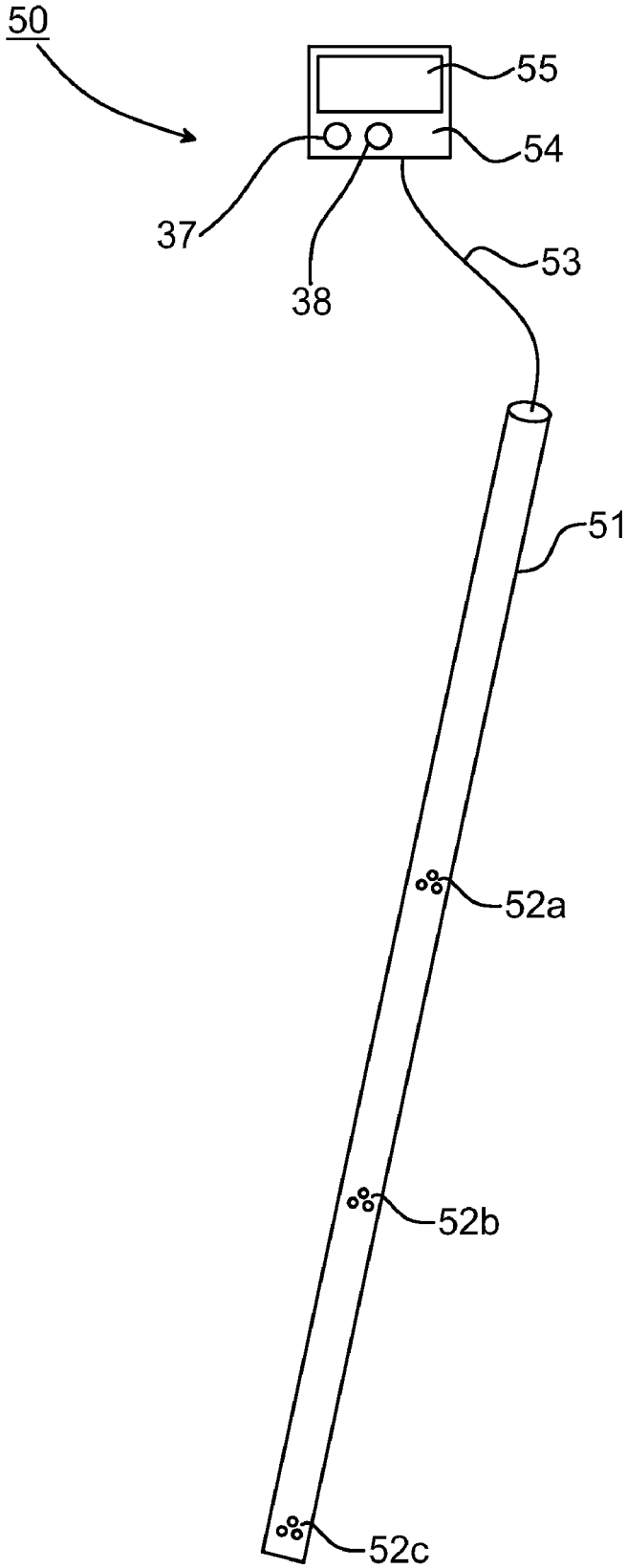
FIG. 5 illustrates an example of measuring equipment for connection to the tap changer.

FIG. 5 illustrates an example of measuring equipment 50 for performing a measuring of the performance of the contacts of the tap changer 4. The measuring equipment 50 comprises measuring instruments (37, 38, 54, 55) that is arranged outside the tap changer during a contact sequence measurement, and means 51, 52 for connecting the instruments to the measuring contact devices 140-142 in the shaft of the tap changer, such as an elongated rod 51 provided with measuring contacts 52A-C. The connecting means 51, 52 is adapted for insertion into the shaft (2) through the sealable opening (9 in FIG. 2) of the tap changer. The measuring equipment includes a measuring probe 51, in the form of a rod 51. The measuring probe 51 is provided with a plurality of measuring contacts 52 corresponding to the measuring contacts of the contact devices 140-142 (in FIG. 1) arranged inside the shaft 2. The measuring probe has a first 52*a*, a second 52*b* and a third 52*c* group of measuring contacts, wherein each group 52*a-c* includes a first, a second and a third contact for connection to a respective one of the three contacts 140A-C of each of the contact devices 140-142 of the shaft. Thereby the three contacts of each group can be connected to the measuring points A, B, C of the movable contact 31. When a measuring is performed and the lid (9 of FIG. 2) has been removed, the measuring probe 51 been inserted, it is these measuring contacts 52*a-c*, nine in total, that connect to the nine corresponding measuring contacts 140*a-c* of the shaft, which by means of the three cables 106-108 connect to the movable contact 103-105, 31 of the shaft 2. The measuring equipment includes a controller or control unit 54 that is provided with a display 55 for providing results to an operator. The controller is connected to the rod 51 by a cable 53, suitably including one individual cable for every measuring point A-C of the tap changer for which the measuring probe 51 is adapted. The controller 54 includes the meters and DC sources 37, 38 which are connected to the measuring points A-C through the cable 53, probe 51 and measuring contacts 52. The controller 54 is arranged outside the transformer during the measuring of the contact sequence. The controller 54 is suitably adapted to control the measuring and determine results to the operator.

As an alternative to a single control unit 54, a computer with a user interface, including a display 55 can be communicatively connected to control a measuring unit that includes the measuring instruments, for example DC sources and resistance meter, or for example DC sources and voltage and current meters.

Figure 6:
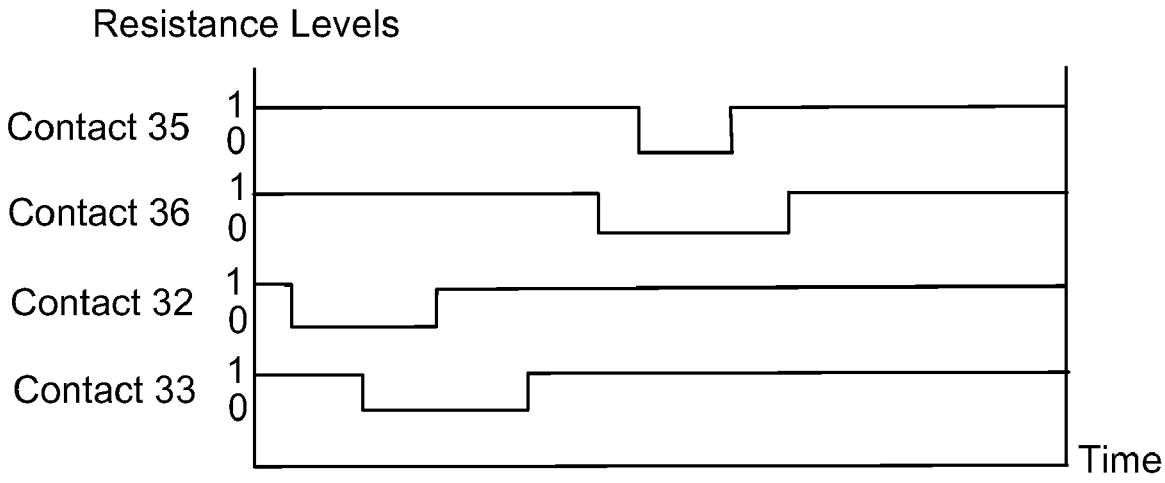
FIG. 6 illustrates a typical switching session for the tap changer measured in FIG. 4.

FIG. 6 illustrates a typical switching sequence of the tap changer 4 when the movable contacts 12, 31 is moved from a first tap of the regulating winding (n) to a second tap (n+1) of the transformer. The resistor branch of the movable contact 31 is first moved to the second tap, i.e. the branch with the second mechanical contact 32 and second vacuum interrupter 33. The movement is provided by the rotation of the shaft 2 with the resistor branch in front of the other branch. When second mechanical contact 32 has disconnected from tap n, the vacuum interrupter 33 of this branch is opened. Thereafter, the second mechanical contact 32 mates with the second tap (n+1), and the second vacuum interrupter 33 is subsequently closed. The first vacuum interrupter 36 is then opened, before the mechanical contact 35 leaves and disconnects from the first tap. The first mechanical contact 35 rotates with the shaft and meets the fixed contact of the second tap, where after the rotation of the shaft is halted. The first vacuum interrupter 36 is not reconnected until the mechanical contact 35 has connected to the second tap (n+1).

Figure 7:
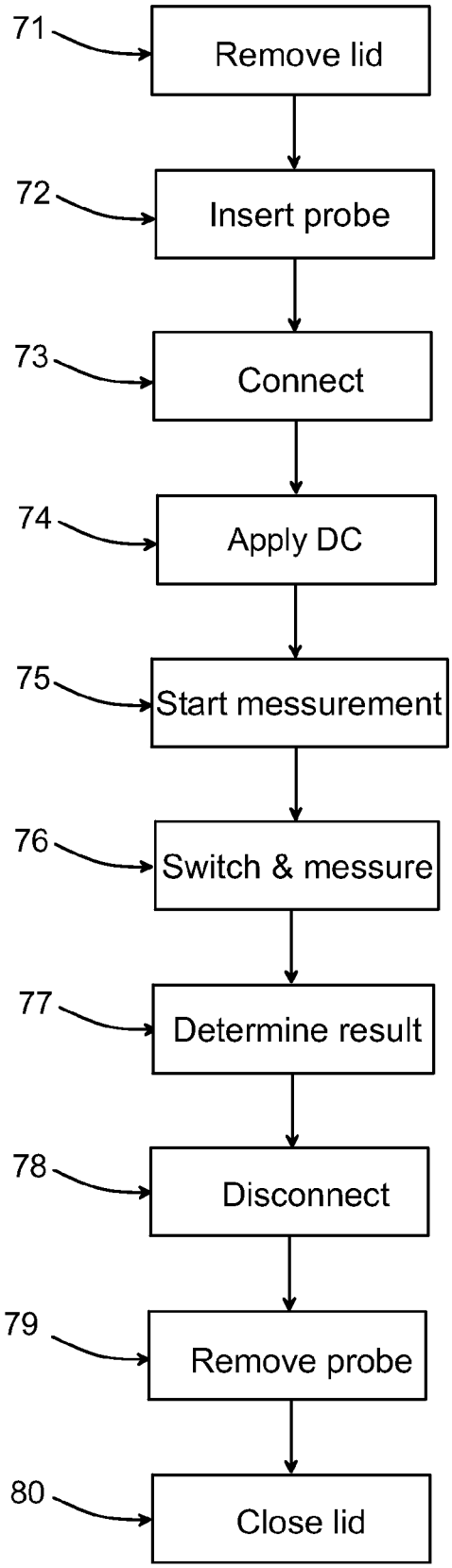
FIG. 7 illustrates a method for measuring in accordance with the invention.

FIG. 7 a method for measuring the performance of the contacts of a tap changer during switching. The method is started by an installation phase, wherein the measuring equipment is connected to the tap changer. The installation includes positioning the measuring probe 51 inside the shaft 2 of the tap changer, with the tap changer 4 in place inside the transformer 18, so that the measuring probe is placed inside the transformer. First, in step 71, the lid of the tap changer is opened. Second, in step 72, the measuring probe is inserted into the opening. Then, in step 73 the measuring contacts 140*a-c*, 52*a-c* is brought into contact with each other 52*a-c*, 140*a-c*, i.e. the measuring contacts 52*a-c* of the probe 51 mate the corresponding measuring contacts 140*a-c* of the shaft. Thus, the installation phase provides an electrical connection between the measuring equipment 37, 38, 54, 55 and the measuring points A, B, C in the contact circuit by means of placing a measuring probe 51 with measuring contacts 52*a-c* inside the transformer 18.

When the installation has been completed a measuring phase is started. The measuring phase includes performing a contact sequence during which the performance of the contacts 32, 33, 35, 36 is monitored by the measuring equipment 37, 38, 54, 55. In step 74, DC currents are applied between measuring points. With a contact device 31, such as illustrated in FIGS. 3 and 4, this includes applying DC between measuring points A and B and between measuring points B and C, respectively, i.e. a first current is applied between the two branches and a second current is applied in parallel with the resistor 34. Then the electrical measurements are initiated (step 75) and performed subsequently. The voltages and currents (step 76) between the measuring points A and B and between B and C is monitored and a result is determined (step 77). During this measurement, the four contacts 32, 33, 35, 36 of the two branches of the movable contact 103-105, 31 of the shaft 2 of the tap changer is connected and disconnected and the voltage levels are monitored by the controller 54, in step 76. The results are suitably presented on the display 55 of the measuring equipment.

When the measuring phase has been completed, the method includes a removal phase, wherein the measuring equipment is removed from the transformer. The measuring ends and the removal phase begin by the disconnection of the measuring contacts 52*a-c* from measuring contacts 140-142A-C (step 78), the probe is removed from the transformer (step 79), i.e. the interior of shaft of the tap changer, and the lid is closed (step 80).

Figure 8:
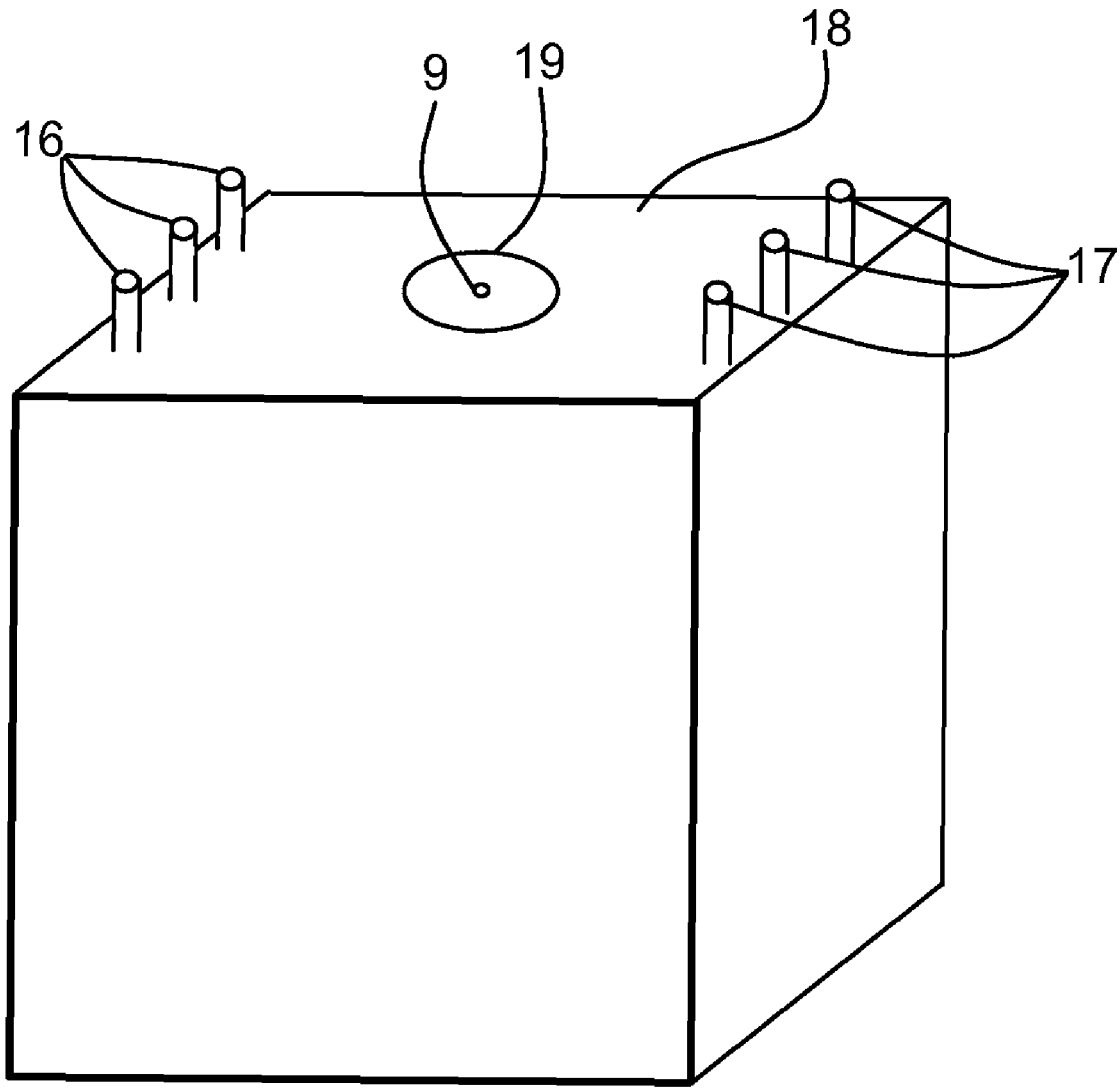
FIG. 8 illustrates a transformer including the tap changer.

FIG. 8 illustrates a transformer 18 comprising a tap changer with a cover 19. The transformer 18 includes three primary side terminals 16, and three secondary side terminals 17. The tap changer 19 is arranged to vary the voltage transformation between the primary 16 and secondary 17 terminals. The tap changer 19 is provided with a lid 9 covering an access into its shaft, wherein a plurality of measuring contacts (140*a-c*, 141*a-c*, 142 *a-c* in FIG. 1) are provided, which contacts are connected to measuring points A, B, C in the contact circuits arranged outside the shaft and inside the transformer. By the arrangement of the measuring points inside the shaft of the tap changer the contact sequence measuring is simplified. The tap changer 19 remains inside the transformer 18 during the total measuring of the contact sequence, i.e. from the installation of the measuring equipment to their removal. The cylinder of the tap changer is suitably sealed and filled with a liquid isolating medium, such as oil. The transformer 18 also contains a liquid isolating medium, for example oil, outside the tap changer, and the oil of the transformer is sealed from the oil of the tap changer.

What is claimed is:

1. A tap changer for a transformer comprising a cylinder and a shaft that is rotatably arranged inside the cylinder, the cylinder being provided with fixed contacts, the shaft being provided with a contact circuit facing the cylinder and including mechanical contacts, which mechanical contacts are adapted to selectively mate with the fixed contacts of the cylinder upon rotation of the shaft, the contact circuit also including at least two measuring points for measuring the function of the contact circuit characterised in comprising at least one measuring contact device, which is electrically connected to the respective measuring points in the contact circuit, the measuring contact device being arranged inside the shaft.

2. The tap changer according to claim 1, wherein the measuring contact device comprises at least two individual contact surfaces, and the contact circuit comprises two measuring points, wherein each of the contact surfaces is connected to a respective one of the measuring points.

3. The tap changer according to claim 1, comprising three measuring contact devices and three contact circuits, wherein each of the contact devices is arranged inside the shaft and is connected to a respective one of the three contact circuits.

4. The tap changer according to claim 3, each measuring contact device comprises three individual contact surfaces, and the contact circuit comprises three measuring points, wherein each of the contact surfaces is connected to a respective one of the measuring points.

5. The tap changer according to claim 2, including a plurality of conductors each of which is arranged between a respective measuring point and contact surface and extends from an outside of the shaft to a respective one of the contact surfaces inside the shaft.

6. The tap changer according to claim 1, having a cover and a sealable opening arranged in the cover, which sealable opening is arranged to provide access into the shaft.

7. The tap changer according to claim 1, wherein the contact circuit comprises two branches, the first branch comprising a first mechanical contact, a first vacuum interrupter and a protective resistor, the second branch comprises a second mechanical contact and a second vacuum interrupter.

8. A transformer comprising two windings, one of which is a regulating winding, and a tap changer arranged to select a tap level of the regulating winding, wherein the tap changer is provided in accordance with claim 1.

9. Measuring equipment for measuring a contact sequence in a tap changer in accordance with claim 1, the measuring equipment comprising a measuring probe provided with measuring contacts adapted for connection to at least one contact device arranged inside the shaft of the tap changer.

10. A method for measuring a contact sequence of a tap changer in a transformer, which tap changer is arranged inside the transformer and comprises a cylinder and a shaft that is rotatably arranged inside the cylinder, the cylinder being provided with fixed contacts, the shaft being provided with a contact circuit including mechanical contacts facing the cylinder and being adapted to selectively mate with the fixed contacts of the cylinder upon rotation of the shaft, wherein measuring contact devices are arranged inside the shaft, which contact devices are electrically connected to measuring points of the contact circuit, the method comprises a step of opening and closing the contacts of the contact circuit and measuring electrical variations by means of measuring equipment during the opening and closing of the contacts, and the method being characterised by inserting a measuring probe provided with measuring contacts into the shaft of the tap changer.

11. The measuring method according to claim 10, wherein the step of inserting the measuring probe is performed with the tap changer present inside the transformer.

12. The measuring method according to claim 10, including the step of connecting the measuring contacts with the contact devices, which connecting step is performed after the insertion of the measuring probe into the shaft.

13. The measuring method according to claim 10, including the step of removing the measuring probe from the shaft including removing the measuring the probe out of the transformer, which step is performed after the step of opening, closing and measuring.

14. The measuring method according to claim 13, including the step of closing the tap changer after the step of removing the measuring probe.

* * * * *